US005554441A

United States Patent [19]

Gupta et al.

[11] Patent Number: 5,554,441

[45] Date of Patent: Sep. 10, 1996

[54] RANDOM MACRODOMAIN MULTICONSTITUENT FIBERS, THEIR PREPARATION, AND NONWOVEN STRUCTURES FROM SUCH FIBERS

[75] Inventors: Rakesh K. Gupta, Conyers; Jon R. Williams, Social Circle, both of Ga.

[73] Assignee: Hercules Incorporated, Wilmington, Del.

[21] Appl. No.: 46,861

[22] Filed: Apr. 16, 1993

[51] Int. Cl.[6] ..... D02G 3/00

[52] U.S. Cl. ..... 428/373; 428/374; 428/401; 525/240; 522/161; 522/912; 522/112

[58] Field of Search ..... 428/373, 374; 525/240; 522/912, 161, 112; 422/22

[56] References Cited

U.S. PATENT DOCUMENTS

| | | | |
|---|---|---|---|
| 3,294,869 | 12/1966 | Robinson . | |
| 3,537,967 | 11/1970 | Kelley et al. . | |
| 3,546,063 | 12/1970 | Breen | 161/176 |
| 3,616,149 | 10/1971 | Wincklhofer et al. | 428/401 |
| 3,940,325 | 2/1976 | Hirao . | |
| 4,282,076 | 8/1981 | Boynton . | |
| 4,350,006 | 9/1982 | Okamoto et al. . | |
| 4,401,536 | 8/1983 | Lundell et al. . | |
| 4,431,497 | 2/1984 | Rekers . | |
| 4,501,856 | 2/1985 | Harpell et al. . | |
| 4,525,257 | 6/1985 | Kurtz et al. . | |
| 4,547,541 | 10/1985 | Golba, Jr. | 524/151 |
| 4,569,736 | 2/1986 | Kusegaki et al. . | |
| 4,598,128 | 1/1986 | Randall et al. . | |
| 4,632,861 | 12/1986 | Vassilatos | 428/296 |
| 4,634,739 | 1/1987 | Vassilatos | 428/288 |
| 4,739,025 | 4/1988 | Burch . | |
| 4,830,907 | 5/1989 | Sawyer et al. | 428/357 |
| 4,839,228 | 6/1989 | Jezic et al. . | |
| 4,874,666 | 10/1989 | Kubo et al. | 428/398 |
| 4,880,691 | 11/1989 | Swyer et al. | 428/228 |
| 4,909,975 | 3/1990 | Sawyer et al. | 264/210.7 |
| 4,931,230 | 6/1990 | Krueger et al. . | |
| 4,990,204 | 2/1991 | Krupp et al. | 156/167 |
| 5,041,491 | 8/1991 | Turke et al. . | |
| 5,059,482 | 10/1991 | Kawamoto et al. | 428/373 |
| 5,108,827 | 4/1992 | Gessner | 428/374 |
| 5,122,593 | 6/1992 | Jennings et al. . | |
| 5,133,917 | 7/1992 | Jezic et al. . | |
| 5,147,936 | 9/1992 | Peszkin et al. . | |
| 5,294,482 | 3/1994 | Gessner | 428/287 |
| 5,487,943 | 1/1996 | Kozulla | 428/373 |

FOREIGN PATENT DOCUMENTS

| | | |
|---|---|---|
| 0192897 | 9/1986 | European Pat. Off. . |
| 0260974 | 3/1988 | European Pat. Off. . |
| 0340655 | 11/1989 | European Pat. Off. . |
| 0361191 | 4/1990 | European Pat. Off. . |
| 0522995 | 1/1993 | European Pat. Off. . |
| 3304491 | 11/1983 | Germany . |
| 3319891 | 12/1984 | Germany . |
| 59-41342 | 3/1984 | Japan . |
| 3-279459 | 12/1991 | Japan . |
| 9010672 | 9/1990 | WIPO . |
| 92/19676 | 11/1992 | WIPO . |

OTHER PUBLICATIONS

English language abstract of Japanese Patent Publication No. 3–279459.

English language abstract of Japanese Patent Publication No. 59–41342.

*Primary Examiner*—B. Hamilton Hess
*Assistant Examiner*—J. M. Gray
*Attorney, Agent, or Firm*—Greenblum & Bernstein P.L.C.

[57] ABSTRACT

Multiconstituent fibers prepared from two or more polymers, with at least one of these polymers being randomly dispersed through the fiber, in the form of domains. At least about 40 percent by weight of these domains have one length of at least 20 microns, measured in the direction along the fiber axis, and have another length, measured along the longest line dissecting the domain cross-section in a plane perpendicular to the fiber axis, of at least about 5 percent of the fiber equivalent diameter.

39 Claims, 4 Drawing Sheets

RANDOM MACRODOMAIN MULTICONSTITUENT FIBERS, THEIR PREPARATION, AND NONWOVEN STRUCTURES FROM SUCH FIBERS

BACKGROUND OF THE INVENTION

1. Field of the Invention

The present invention relates to multiconstituent fibers and their preparation, and to nonwoven structures prepared from such fibers.

2. Description of Background and Other Information

Multiconstituent fibers, and means for their preparation, are known in the art. References in this area include U.S. Pat. No. 3,616,149 (WINCKLHOFER), U.S. Pat. No. 4,634,739 (VASSILATOS '739,) U.S. Pat. No. 4,632,861 (VASSILATOS '861, a division of VASSILATOS '739), U.S. Pat. No. 4,839,228 (JEZIC et al. '228), U.S. Pat. No. 5,133,917 (JEZIC et al. '917, a continuation of JEZIC et al. '228), and U.S. Pat. No. 5,108,827 (GESSNER).

Various known methods, of preparing multiconstituent fibers, include procedures which involve dry blending, then extruding the polymers, or subjecting the dry blended polymers to melting, and possibly additional blending, before extrusion. In these methods, the polymers are invariably blended before melting is effected; accordingly, separate melting of the individual polymers does not occur.

Because the prior art processes do not employ separate melting of the polymers, prior to their blending, intimate mixing of the polymers is invariably effected, before the extrusion step which provides the fibers. Consequently, the domain size of the dispersed polymers is limited in one or more dimensions; for instance, the domains are narrow or fine, relative to the width of the fiber—e.g., they do not, individually, occupy much of the fiber cross-sectional area, or they have a small equivalent diameter, in comparison with that of the fiber—and/or they are short—i.e., they do not extend for a long distance, along the axis of the fiber.

For instance, among the results obtained, in the prior art processes, are continuous/discontinuous phase dispersions with the discontinuous phase provided in domains which typically have a width of less than one micron, at their widest point in cross-section, along the diameter of the fiber, or which have a cross-section no larger than 0.1 percent of the fiber's cross-sectional area. Further, where the miscibility or melt viscosity of the discontinuous phase component is widely different than that of the continuous phase component, the former can end up present in the form of discrete short fibrils, typically of less than 10 microns in length.

The fibers obtained from these prior art processes lack availability of the lower melting point polymer, on the fiber surface. In consequence, they fail to provide good thermal bondability between fibers.

As indicated, the prior art does not disclose or suggest, in the preparation of multiconstituent fibers, prior and separate melting, of the individual polymers, before their blending. The prior art further does not disclose or suggest, along with such prior, individual melting, moderating the degree of subsequent blending, and, if necessary, the initial relative amounts of the polymers, so that the ultimately resulting multiconstituent fiber is characterized by larger polymer domains than are provided by the prior art processes.

In this regard, it has been discovered that prior, separate melting, of the individual polymers, inhibits, or retards, the mixing of the polymers in the subsequent blending. Appropriate limitation of the amount of mixing, in such subsequent blending, and corresponding control of the relative amounts of the polymers employed, prevents the polymers from being broken up to the degree which is provided in the prior art, and results in the macrodomains, of the multiconstituent fibers of the invention.

The multiconstituent fibers of the invention provide novel and unexpected advantages, over those in the prior art. As an example, the presence of the polymer macrodomains effects superior bonding of the fibers, in the preparation of nonwoven structures or fabrics, particularly where low pressure thermal techniques are employed.

Such superior bonding especially occurs where the fibers of the invention comprise immiscible, or at least substantially immiscible, thermoplastic polymers of different melting points—whereby the application of heat melts the lower melting point components of the fibers, and the intermelding of such components, among the fibers, effects their bonding—and, more especially, where the at least two polymers are present in unequal amounts by weight, and the polymer present in the lesser amount is that having the lower melting point. As a particularly preferred embodiment, the superior bonding is realized in linear polyethylene/linear polypropylene multiconstituent, especially biconstituent, fibers of the invention, where the polyethylene is the lower melting point and lesser amount component.

As another advantage, the fibers of the invention can be thermally bonded without the use of any applied pressure, thereby resulting in lofty nonwoven structures, suitable for filtration, and other applications. Such superior low pressure thermal bondability particularly results where the fibers of the invention feature at least two polymers of different melting points, with the lower melting of these polymers provided as macrodomains; in this instance, the indicated favorable bondability is effected by the availability of the lower melting polymer component—due to its macrodomain dimensions.

SUMMARY OF THE INVENTION

The invention pertains to a multiconstituent fiber, comprising at least two polymers. At least one of these polymers is randomly dispersed through the fiber, in the form of domains; for each such polymer, thusly randomly dispersed, at least about 40 percent by weight of the domains have a first dimension of at least about 5 percent of the equivalent diameter of the fiber, and have a second dimension of at least about 20 microns.

More preferably, at least about 40 percent by weight of the domains have a first dimension of at least about 10 percent of the equivalent diameter of the fiber, and have a second dimension of at least about 100 microns. In a particularly preferred embodiment, at least about 50 percent by weight of the domains have a first dimension of from about 10 percent to about 80 percent of the equivalent diameter of the fiber, and have a second dimension of at least about 100 microns.

In the multiconstituent fiber of the invention, the at least two polymers can be provided in a configuration wherein one of the polymers is a continuous phase, with at least one other polymer randomly dispersed therethrough as a discontinuous phase, in the form of the domains. As an alternative configuration, all, or at least substantially all, of the at least two polymers can be randomly dispersed, in the form of the domains.

Preferably, there is a difference of at least 10° C., or about 10° C., between the melting points of the at least two polymers, of the multiconstituent fiber of the invention. As a matter of particular preference, in such instance, the indicated at least two polymers comprise polypropylene, as the higher melting point polymer, and polyethylene or an ethylene-propylene copolymer.

Where the polymers are provided in the indicated continuous/discontinuous phase configuration, the melting point of the continuous phase polymer is preferably at least about 10° C. higher than the melting point of the at least one discontinuous phase polymer; specifically for this configuration, also as a matter of particular preference, the continuous phase polymer comprises polypropylene, and the at least one discontinuous phase polymer comprises polyethylene and/or an ethylene-propylene copolymer. This melting point difference is also preferred for the indicated alternative configuration.

In a preferred embodiment, the multiconstituent fiber of the invention is a biconstituent fiber. As a particularly preferred embodiment, the two polymers of the indicated biconstituent fiber of the invention are the indicated polypropylene and polyethylene, or polypropylene and an ethylene-propylene copolymer.

The relative proportions, of the polymers employed in the multiconstituent fibers of the invention, can be determined according to the properties desired in the fiber. Where polypropylene and polyethylene are employed, or when polypropylene and an ethylene-propylene copolymer are employed —particularly, for either instance, in a biconstituent fiber of the invention—the use of from about 10 to about 90 percent by weight polypropylene, and from about 90 to about 10 percent by weight polyethylene or ethylene-propylene copolymer, or from about 20 to about 80 percent by weight polypropylene, and from about 80 to about 20 percent by weight polyethylene or ethylene-propylene copolymer—these proportions being based on the total weight of the polypropylene, and the polyethylene or ethylene-propylene copolymer—is within the scope of the invention. Particular suitable combinations—as indicated, based on the total weight of the polypropylene and the polyethylene or ethylene-propylene copolymer—include the following:

- about 80 percent by weight polypropylene, and about 20 percent by weight polyethylene or ethylene-propylene copolymer;
- about 60 percent by weight polypropylene, and about 40 percent by weight polyethylene or ethylene-propylene copolymer;
- about 50 percent by weight polypropylene, and about 50 percent by weight polyethylene or ethylene-propylene copolymer; and
- about 35 percent by weight polypropylene, and about 65 percent by weight polyethylene or ethylene-propylene copolymer.

The invention further pertains to nonwoven fabrics or structures comprising multiconstituent fibers of the invention.

The invention yet further pertains to a method of preparing a multiconstituent fiber, comprising at least two polymers, at least one of the polymers being randomly dispersed through the fiber, in the form of domains. The method of the invention comprises the following steps:

(a) separately melting each of the at least two polymers;

(b) mixing the separately melted polymers, to obtain a blend; and (c) extruding the blend, to obtain the multiconstituent fiber.

In addition to being separately melted, the at least two polymers may also be extruded, prior to the blending of step (b). Particularly in this regard, step (a) may be accomplished by means of using a separate extruder for each of the polymers—specifically, by melting each of these polymers in, then extruding each from, its own extruder; after such treatment, the polymers melts are subjected to the mixing of step (b), and the extrusion of step (c).

Preferably, step (b) comprises the amount of mixing which provides that, for each polymer randomly dispersed in the form of domains, in the multiconstituent fiber obtained in step (c), at least about 40 percent by weight of the domains have a first dimension of at least about 5 percent of the equivalent diameter of the fiber, and have a second dimension of at least about 20 microns. More preferably, the amount of mixing in step (b) is such that, for each polymer randomly dispersed in the form of domains, in the multiconstituent fiber obtained in step (c), at least about 40 percent by weight of the domains have a first dimension of at least about 10 percent of the equivalent diameter of the fiber, and have a second dimension of at least about 100 microns; most preferably, the amount of mixing in step (b) is such that, for each polymer randomly dispersed in the form of domains, in the multiconstituent fiber obtained in step (c), at least about 50 percent by weight of the domains have a first dimension of from about 10 percent to about 80 percent of the equivalent diameter of the fiber, and have a second dimension of at least about 100 microns.

In the process of the invention, the at least two polymers can be employed in relative amounts so as to provide, in the multiconstituent fiber obtained in step (c), the previously discussed continuous/discontinuous phase configuration. Alternatively, the polymers can be employed in such relative amounts that result in the indicated multiple domain configuration.

DESCRIPTION OF THE INVENTION

Figure 1:
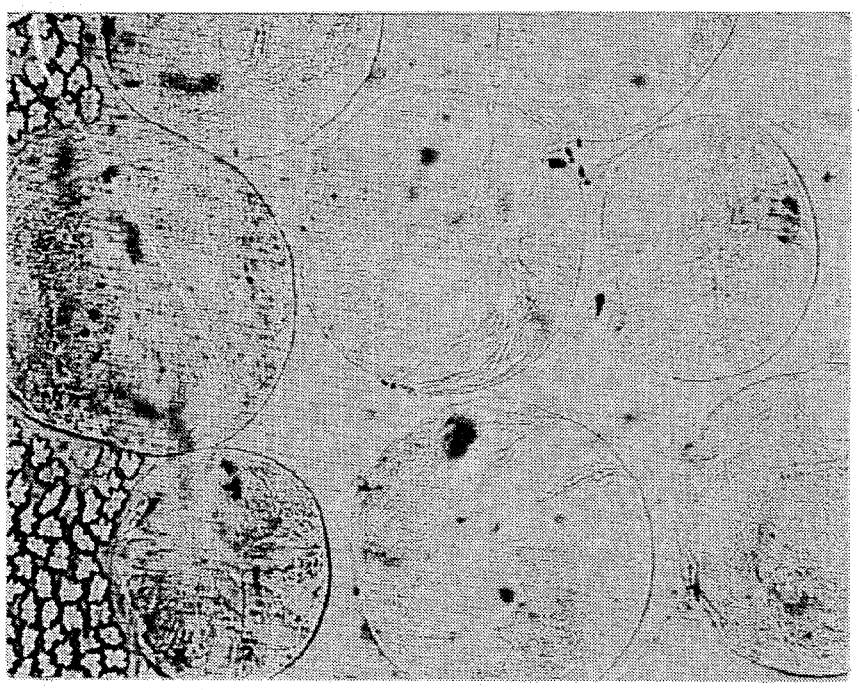
FIGS. 1–6 are photomicrographs of cross-sections of 200 micron diameter fibers of the invention, before stretching, crimping, and cutting, enlarged 200 times.
Figure 2:
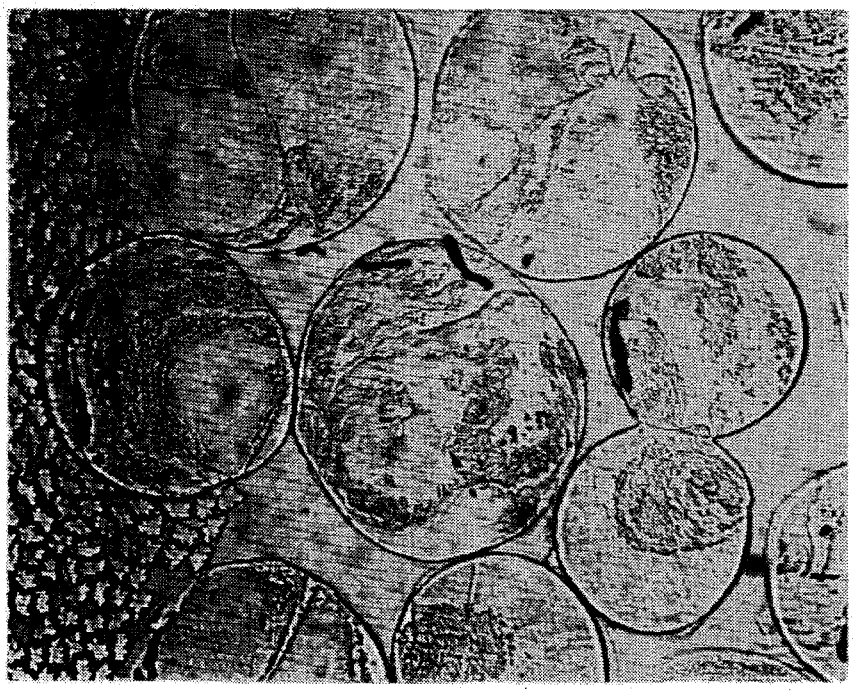
Figure 3:
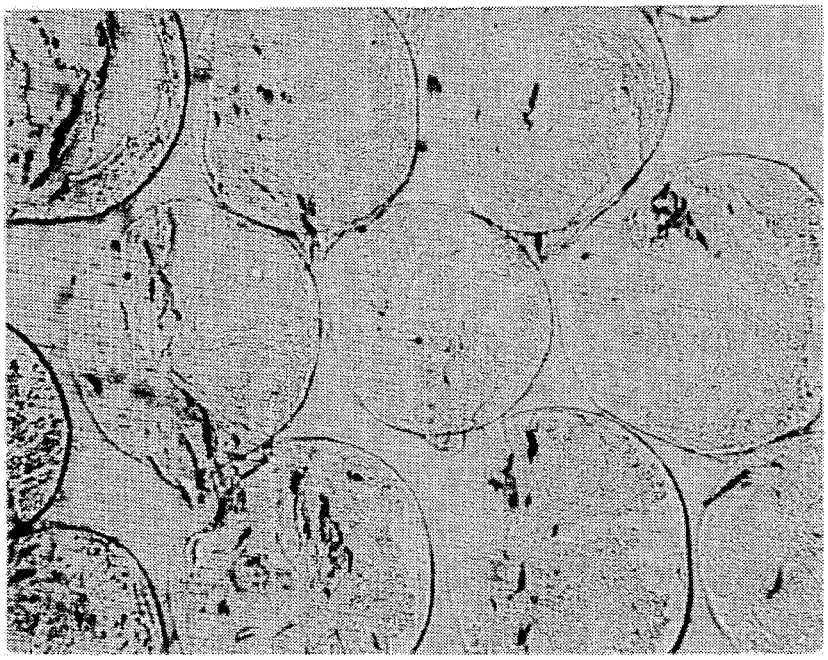
Figure 4:
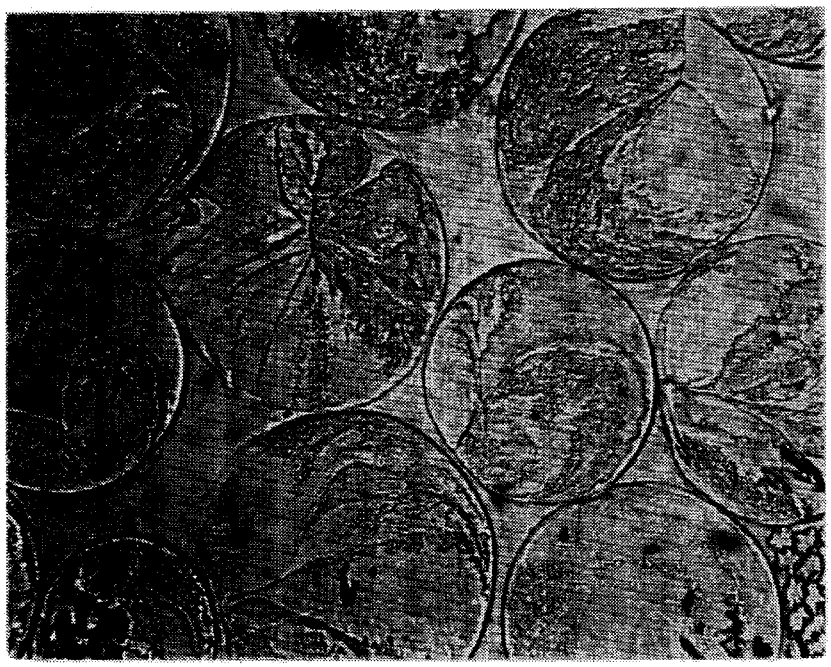
Figure 5:
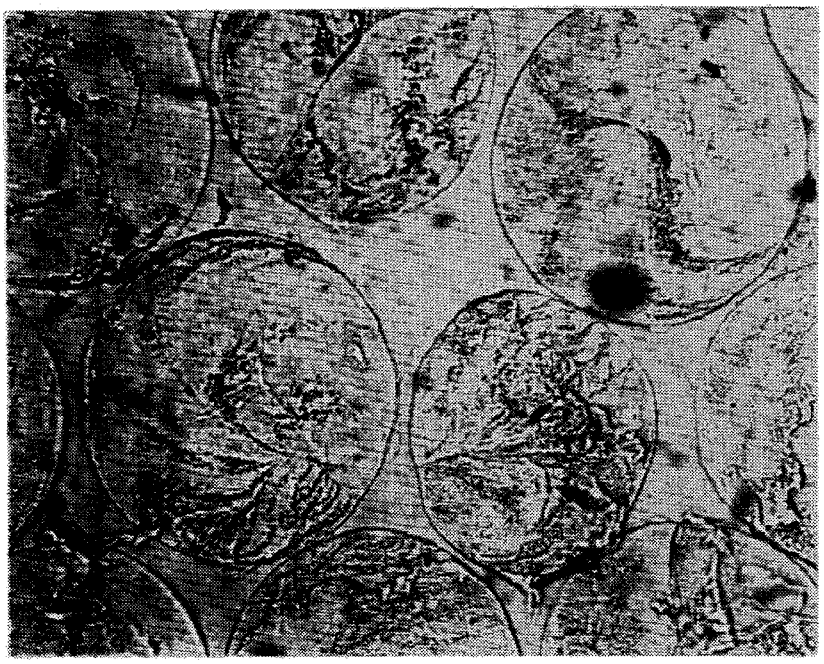
Figure 6:
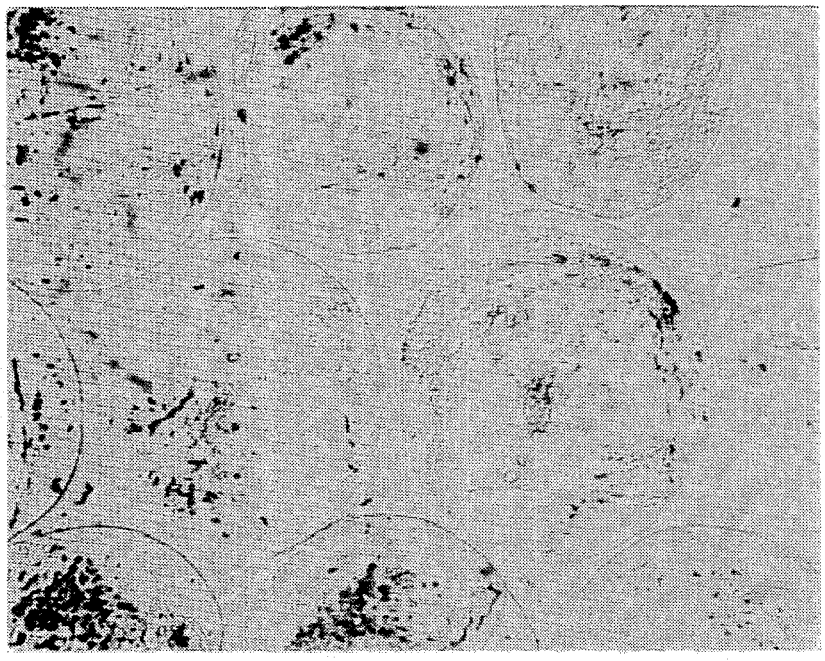

The term "equivalent diameter" is recognized in the art, and is used herein in accordance with its commonly understood meaning; specifically, this is a parameter common to fibers generally, whether or not they are circular in cross-section. The equivalent diameter, of a particular fiber, is the diameter of a circle having the same area as a cross-section of that fiber.

The domain first dimension, as referred to herein, is the distance between the two farthest points in the domain cross-section, measured by a line which connects these points, and which dissects the domain cross-section into two equal halves. In this regard, the domain cross-section is taken perpendicular to the fiber axis—i.e., the domain cross-section lies in the plane of the fiber cross-section.

The domain second dimension, as referred to herein, is measured in the direction along the axis of the fiber.

The polymers of the invention are those suitable for the preparation of multiconstituent fibers, including multiconstituent fibers which are biconstituent fibers. The terms "multiconstituent" and "biconstituent" are used herein in accordance with their accepted meaning in the art, as is the term "domain".

The multiconstituent fibers are understood as including those fibers comprising at least one polymer dispersed in domains, as at least one discontinuous phase, throughout another polymer, provided in the form of a continuous phase. The multiconstituent fibers are further understood as including those fibers comprising at least two or more polymers interdispersed in domains; such dispersion may be random.

The fibers of the invention are multiconstituent fibers, including biconstituent fibers; more specifically, the fibers of the invention are macrodomain multiconstituent fibers, especially random macrodomain multiconstituent fibers —as indicated, including the biconstituent fibers. The term "macrodomain", as used herein, refers to the greater polymer domain size which characterizes the fibers of the invention, in contrast with the small domained multiconstituent fibers of the prior art.

The at least two polymers, of the multiconstituent fibers of the invention, are preferably thermoplastic, and also preferably immiscible, or at least substantially immiscible. Further as a matter of preference, at least two of the polymers employed, for a multiconstituent fiber of the invention, have different melting points; most preferably, they have a melting point difference of at least 10° C., or about 10° C.

Polymers suitable for the multiconstituent fibers of the invention include those polymers as disclosed in WINCKLHOFER, VASSILATOS '739, VASSILATOS '861, JEZIC et al. '228, JEZIC et al. '917, and GESSNER. These patents are incorporated herein in their entireties, by reference thereto.

Particular polymers, which are appropriate for the multiconstituent fibers of the invention, include the polyethylenes (PE), such as the following: the low density polyethylenes (LDPE), preferably those having a density in the range of about 0.90–0.935 g/cc; the high density polyethylenes (HDPE), preferably those having a density in the range of about 0.94–0.98 g/cc; the linear low density polyethylenes (LLDPE), preferably those having a density in the range of about 0.94–0.98 g/cc, and including those prepared by copolymerizing ethylene with at least one $C_3$–$C_{12}$ alpha-olefin.

Also suitable are the polypropylenes (PP), including the atactic, syndiotactic, and isotactic—including partially and fully isotactic, or at least substantially fully isotactic -polypropylenes.

Yet further polymers which may be employed, for the multiconstituent fibers of the invention, include the following: ethylene-propylene copolymers, including block copolymers of ethylene and propylene, and random copolymers of ethylene and propylene; polybutylenes, such as poly-1-butenes, poly-2-butenes, and polyisobutylenes; poly 4-methyl-1-pentenes (TPX); polycarbonates; polyesters, such as poly (oxyethyleneoxyterephthaloyl); polyamides, such as poly (imino-1-oxohexamethylene) (Nylon 6), hexamethylene-diaminesebacic acid (Nylon 6–10), and polyiminohexamethyleneiminoadipoyl (Nylon 66); polyoxymethylenes; polystyrenes; styrene copolymers, such as styrene acrylonitrile (SAN); polyphenylene ethers; polyphenylene oxides (PPO) ;polyetheretherketones (PEEK); polyetherimides; polyphenylene sulfides (PPS); polyvinyl acetates (PVA); polymethyl methacrylates (PMMA); polymethacrylates (PMA); ethylene acrylic acid copolymers; and polysulfones.

Two or more polymers can be employed, in whatever relative amounts are suitable for obtaining a product characterized by the properties desired for a particular purpose. The types and proportions, of the polymers used, can be readily determined by those of ordinary skill in the art, without undue experimentation.

Particularly preferred, is the combination of a polypropylene, particularly at least 90 percent isotactic polypropylene, and either a polyethylene of lower (preferably at least 10° C., or about 10° C. lower) melting point, particularly a high density polyethylene, or an ethylene-propylene copolymer of such lower melting point, to provide a biconstituent fiber of the invention. Suitable commercially available isotactic polypropylenes include PD 701 (having a melt flow rate of about 35) and PH012 (having a melt flow rate of about 18), both available from HIMONT U.S.A., Inc., Wilmington, Del., while suitable commercially available high density polyethylenes include T60-4200, available from Solvay Polymers, Inc., Houston Tex.; suitable commercially available ethylene-propylene copolymers include FINA Z9450, available from Fina Oil and Chemical Company, Dallas, Tex.

In preparation of the multiconstituent fibers of the invention, each of the polymers is separately melted. This may be accomplished by using a separate extruder for each polymer—specifically, by melting each polymer in, then extruding each polymer from, its own extruder.

The separately melted polymers are then subjected to mixing; such mixing is preferably effected to the polymers while they are in their molten state, i.e., to the polymer melts. They may be fed to this mixing step by the use of separate pumps, one for each of the polymers.

Because of the immiscibility, or at least substantial immiscibility, of the polymers which are employed, the indicated mixing effects random interdispersion of the polymers, and contributes to the formation of polymer domains.

A factor affecting the configuration, of the interdispersed polymers, is the relative amounts in which they are provided to the mixing step. Such relative amounts can be controlled by varying the speeds of the indicated separate pumps.

Where any of the polymers is thusly provided, in an amount which is sufficiently greater than the amount of the one or more other polymers, then the indicated first polymer accordingly provides a continuous phase, wherein domains, of such one or more other polymers, are randomly interdispersed. If there is no such preponderance of any single polymer, then all of the polymers are present in the form of such randomly dispersed domains.

The degree of preponderance which is sufficient to provide the indicated continuous/discontinuous phase configuration, as opposed to a configuration wherein all of the polymers are provided in domains, depends, inter alia, upon the identities of the polymers which are employed. For any particular combination of polymers, the requisite relative amounts, for providing the requisite configuration, can be readily determined by those of ordinary skill in the art, without undue experimentation.

For whatever of the configurations does result, the size, of the polymer domains, is affected by different factors. The indicated relative proportions, of the polymers employed, discussed above as affecting the resulting configuration, is likewise one factor which determines domain size.

Yet a second factor is the degree of mixing which is employed. Specifically, the greater the amount of mixing, the smaller the size of the resulting domains.

In this context, the extruded polymers are employed in the proper ratios, and subjected to the suitable degree of mixing, which provide domains within the scope of the present invention. Particularly with respect to the latter of the two indicated factors, the amount of mixing employed is accordingly sufficient so as to provide domains of the requisite size, but not so great so that the domains are reduced to a size below that of the present invention.

As previously noted with respect to the types and proportions of polymers employed, the requisite degree of mixing can be likewise be readily determined by those of ordinary skill in the art, without undue experimentation. Particularly, appropriate combinations, of suitable polymer ratios and degrees of mixing, can be thusly readily determined.

Correspondingly, the relative proportions of the polymers, and the amount of mixing employed, are such as to provide the random macrodomain multiconstituent polymers of the invention. Preferably these relative polymer proportions, and amount of mixing, are such that, for each polymer randomly dispersed, in the multiconstituent fiber ultimately obtained, at least about 40 percent by weight of the domains have a first dimension of at least about 5 percent of the equivalent diameter of the fiber, and have a second dimension of at least about 20 microns.

Still more preferably, the ratios of the polymers, and the amount of the mixing, are such that, for each of the thusly randomly dispersed polymers, at least 40 percent by weight of the domains have a first dimension of at least about 10 percent of the equivalent diameter of the fiber, and have a second dimension of at least about 100 microns; most preferably, the ratios of the polymers, and the amount of the mixing, are such that, for each of the thusly randomly dispersed polymers, at least about 50 percent by weight of the domains have a first dimension of from about 10 percent to about 80 percent of the equivalent diameter of the fiber, and have a second dimension of at least about 100 microns.

The mixing may be conducted by any means which will provide the requisite results, such as by use of a static mixing device, containing mixing elements. The more of such mixing elements are employed, in the static mixing device, the greater will be the degree of mixing; suitable mixing elements include the ½" inch schedule 40 pipe size mixing elements with eight corrugated layers, manufactured by Koch Engineering Company, New York, N.Y.

Blends resulting from the foregoing mixing step are fed to a spinneret, wherein they are heated, and from which they are extruded, in the form of filaments. These filaments are subjected to the requisite stretching and crimping, then cut to obtain staple fibers.

The foregoing stretching, crimping, and cutting treatment—particularly the stretching—have a corresponding, or at least substantially corresponding, effect upon the diameter of the fiber and the first dimension of the domains. Specifically, the fiber diameter and the domain first dimensions are both shortened, in absolute terms, but in the same, or substantially the same, ratio; accordingly, these dimensions retain the same, or at least approximately the same, relationship to each other.

These resulting staple fibers can be used for the preparation of nonwoven fabrics. Specifically, they can be made into webs, with any of the known commercial processes, including those employing mechanical, electrical, pneumatic, or hydrodynamic means for assembling fibers into a web—e.g., carding, airlaying, carding/hydroentangling, wetlaying, hydroentangling, and spunbonding (i.e., meltspinning of the fibers directly into fibrous webs, by a spunbonding process)—being appropriate for this purpose. The thusly prepared webs can be bonded by any suitable means, such as thermal and sonic bonding techniques, like calender, through-air, and ultrasonic bonding.

Nonwoven fabrics or structures, prepared from random macrodomain multiconstituent fibers of the invention, are suitable for a variety of uses, including, but not limited to, coverstock fabrics, disposable garments, filtration media, face masks, and filling material.

The invention is illustrated by the following Examples, which are provided for the purpose of representation, and are not to be construed as limiting the scope of the invention. Unless stated otherwise, all percentages, parts, etc. are by weight.

EXAMPLE 1

Random macrodomain biconstituent fibers, of the invention, were prepared from PH012 polypropylene and T60-4200 high density polyethylene. Several runs were conducted, as set forth below.

In each run, these two polymers were fed to two different extruders, wherein they were melted to 260° C. The molten polymers were extruded, each from its respective extruder, and fed to a static mixing device, containing mixing elements (½" schedule 40 pipe size mixing elements with 8 corrugated layers, manufactured by Koch Engineering Company, New York, N.Y.).

The relative proportions of the polymers, and the number of mixing elements employed, were varied between the runs, to achieve the preferred degree of mixing, for ultimately obtaining fibers of the invention. The polymer proportions, and number of mixing elements, were as follows for the different runs:

| Run | % Polypropylene | % Polyethylene | Number of Mixing Elements |
|---|---|---|---|
| A | 50 | 50 | 3 |
| B | 50 | 50 | 2 |
| C | 60 | 40 | 3 |
| D | 60 | 40 | 2 |
| E | 80 | 20 | 3 |
| F | 80 | 20 | 2 |

For each run, after the indicated melting, and subsequent mixing in the static mixing device, the resulting mixed polymer melt was extruded through a spinneret having 105 holes, providing filaments approximately 200 microns in diameter. FIGS. 1–6 are photomicrographs of cross-sections taken from fibers of each of Runs A–F, respectively, enlarged 200 times.

The darker areas represent the high density polyethylene macrodomains. Accordingly, these photomicrographs demonstrate the random macrodomain distribution of the polymers, in accordance with the invention.

EXAMPLE 2

Fibers of the invention were prepared, using the polymers and procedures of Example 1, and then additionally subjected to stretching, crimping, and cutting. As with Example 1, several runs were conducted—i.e., Runs G–J, as set forth below.

Regarding the parameters set forth in the following table, the spin dtex is the weight in grams for 10,000 meters of each filament. As to the indicated subsequent treatment, the filaments thusly provided were stretched and crimped, to have the specified staple dpf and crimps per centimeter, and cut into staple fibers, of the specified staple lengths, for conversion into nonwoven structures.

| Run | % PP | % PE | # of Mixing Elements | Melt Temp (°C.) | Spin dtex | Draw Ratio | Staple dpf | Crimps per cm | Cut Length (cm) |
|---|---|---|---|---|---|---|---|---|---|
| G | 35 | 65 | 3 | 250 | 10.0 | 2.4X | 4.2 | 11.8 | 4.7 |
| H | 50 | 50 | 3 | 240 | 10.0 | 3.25X | 3.8 | 13.8 | 4.7 |
| I | 50 | 50 | 3 | 230 | 32.8 | 2.5X | 14.0 | 11.4 | 2.5 |
| J | 50 | 50 | 3 | 230 | 14.8 | 3.2X | 6.2 | 10.2 | 3.8 |

Figure 7:
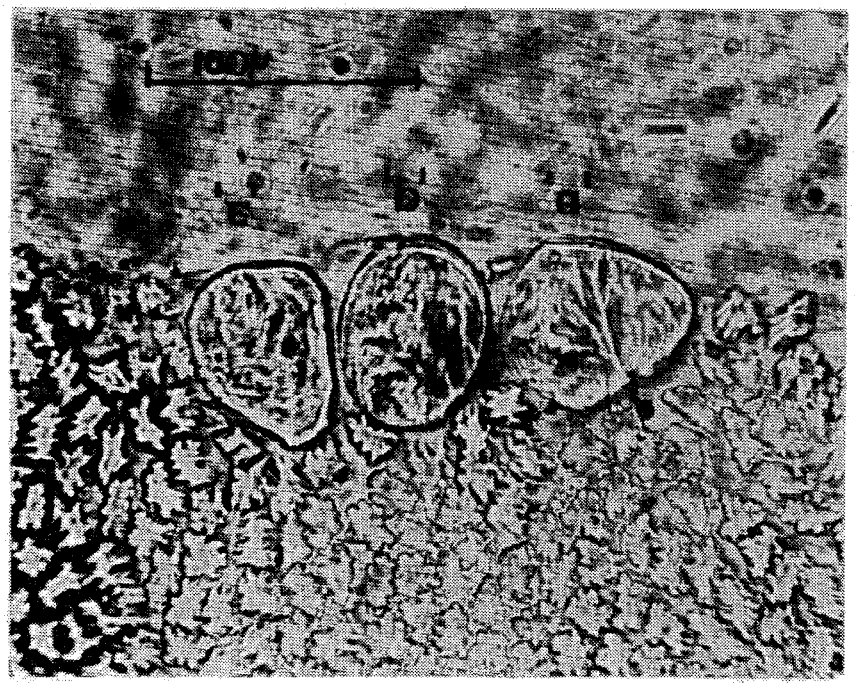
FIGS. 7 and 8 are photomicrographs of cross-sections taken 50 microns apart, along the lengths of fibers of the invention, after stretching, crimping and cutting, enlarged 400 times.
Figure 8:
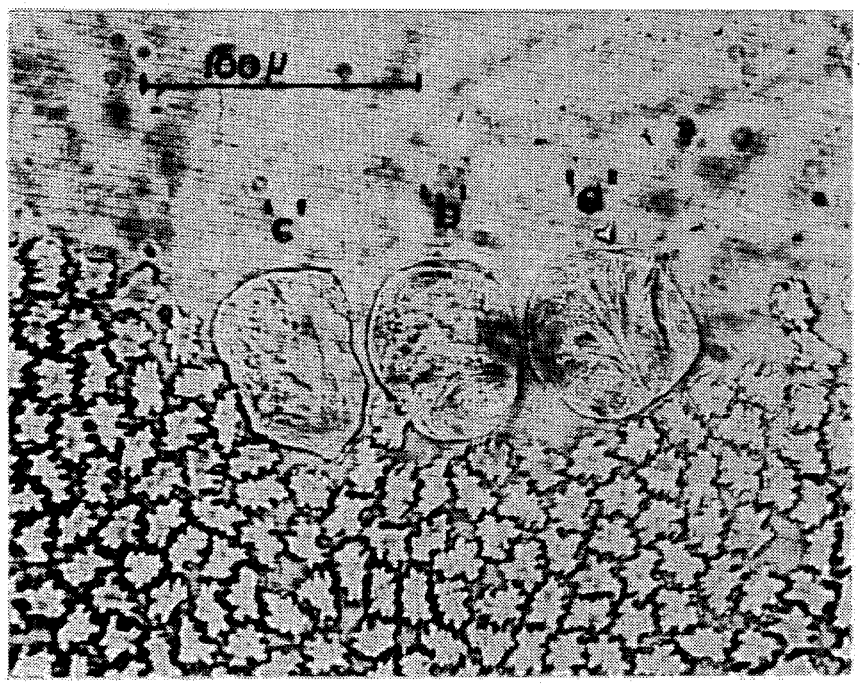

FIGS. 7 and 8 are photomicrographs of cross-sections taken 50 microns apart, along the lengths of the same three fibers from Run I—identified as fibers a, b, and c—enlarged 400 times. As in FIGS. 1–6, the darker areas represent the high density polyethylene macrodomains.

A comparison of FIG. 7, which shows the initial cross-sections taken from each of fibers a, b, and c, with FIG. 8, which shows the subsequent cross-sections taken from these same fibers, demonstrates that the domain patterns represented in the indicated initial and subsequent cross-sections are essentially the same; it is accordingly apparent that the same domains are shown in the initial and subsequent cross-sections. The cross-sections, as indicated, having been taken 50 microns apart, these domains are therefore at least 50 microns in length, along the axis of these fibers—i.e., they have a second dimension of at least 50 microns in length.

In Examples 3 and 4, thermal bonded nonwoven structures were prepared by calender bonding, according to the conditions set forth below for these Examples, using the staple fibers of Runs G and H, respectively. For both Examples, the staple fibers were carded into nonwoven webs of different basis weights, and thermally bonded, using two smooth calender rolls at the line speed of 12 meters/minute.

Further for both Examples, the calender roll temperatures and pressures were varied, also as shown below. The fabrics were tested for strength in the cross-direction (CD), this being the direction perpendicular to the machine direction; the fabric CD grab strength and elongation values were measured using the ASTM D1682-64 test procedure.

EXAMPLE 3

| Sample # | Fabric Weight (g/Sq. Meter) | Roll Temp. (°C.) | Roll Pressure (kg/cm) | CD Grab Strength (g) | CD Elongation (%) |
|---|---|---|---|---|---|
| G-1 | 42 | 130 | 2.7 | 340 | 12 |
| G-2 | 42 | 130 | 7.2 | 1083 | 14 |
| G-3 | 42 | 130 | 11.6 | 1386 | 10 |
| G-4 | 60 | 130 | 2.7 | 153 | 18 |
| G-5 | 60 | 130 | 7.2 | 550 | 8 |
| G-6 | 60 | 130 | 11.6 | 1033 | 10 |
| G-7 | 42 | 135 | 2.7 | 4044 | 27 |
| G-8 | 42 | 135 | 7.2 | 4266 | 21 |
| G-9 | 42 | 135 | 11.6 | 4091 | 16 |
| G-10 | 60 | 135 | 2.7 | 1361 | 16 |
| G-11 | 60 | 135 | 7.2 | 1651 | 9 |
| G-12 | 60 | 135 | 11.6 | 2720 | 11 |
| G-13 | 42 | 140 | 2.7 | 4383 | 29 |
| G-14 | 42 | 140 | 7.2 | 3904 | 15 |
| G-15 | 42 | 140 | 11.6 | 4172 | 16 |
| G-16 | 60 | 140 | 2.7 | 5590 | 31 |
| G-17 | 60 | 140 | 7.2 | 6509 | 21 |
| G-18 | 60 | 140 | 11.6 | 5671 | 18 |

-continued

| Sample # | Fabric Weight (g/Sq. Meter) | Roll Temp. (°C.) | Roll Pressure (kg/cm) | CD Grab Strength (g) | CD Elongation (%) |
|---|---|---|---|---|---|
| G-19 | 42 | 145 | 2.7 | 4492 | 20 |
| G-20 | 42 | 145 | 7.2 | 3965 | 10 |
| G-21 | 42 | 145 | 11.6 | 4092 | 11 |
| G-22 | 60 | 145 | 2.7 | 6320 | 29 |
| G-23 | 60 | 145 | 7.2 | 6631 | 18 |
| G-24 | 60 | 145 | 11.6 | 6857 | 18 |
| G-25 | 42 | 150 | 2.7 | 3935 | 13 |
| G-26 | 42 | 150 | 7.2 | 3039 | 12 |
| G-27 | 60 | 150 | 2.7 | 6606 | 27 |
| G-28 | 60 | 150 | 7.2 | 5914 | 14 |

EXAMPLE 4

| Sample # | Fabric Weight (g/Sq. Meter) | Roll Temp. (°C.) | Roll Pressure (kg/cm) | CD Grab Strength (g) | CD Elongation (%) |
|---|---|---|---|---|---|
| H-1 | 42 | 130 | 2.7 | 298 | 8 |
| H-2 | 42 | 130 | 7.2 | 503 | 11 |
| H-3 | 42 | 130 | 11.6 | 626 | 14 |
| H-4 | 60 | 130 | 2.7 | 80 | 24 |
| H-5 | 60 | 130 | 7.2 | 291 | 11 |
| H-6 | 60 | 130 | 11.6 | 345 | 13 |
| H-7 | 42 | 135 | 2.7 | 1988 | 12 |
| H-8 | 42 | 135 | 7.2 | 2677 | 14 |
| H-9 | 42 | 135 | 11.6 | 2927 | 18 |
| H-10 | 60 | 135 | 2.7 | 664 | 11 |
| H-11 | 60 | 135 | 7.2 | 1439 | 8 |
| H-12 | 60 | 135 | 11.6 | 1897 | 10 |
| H-13 | 42 | 140 | 7.2 | 4600 | 24 |
| H-14 | 42 | 140 | 11.6 | 4304 | 23 |
| H-15 | 60 | 140 | 2.7 | 2221 | 12 |
| H-16 | 60 | 140 | 7.2 | 3775 | 13 |
| H-17 | 60 | 140 | 11.6 | 4405 | 14 |
| H-18 | 42 | 145 | 2.7 | 3101 | 24 |
| H-19 | 42 | 145 | 7.2 | 4321 | 20 |
| H-20 | 42 | 145 | 11.6 | 6062 | 26 |
| H-21 | 60 | 145 | 2.7 | 3882 | 15 |
| H-22 | 60 | 145 | 7.2 | 5486 | 19 |
| H-23 | 60 | 145 | 11.6 | 6705 | 19 |
| H-24 | 42 | 150 | 2.7 | 4883 | 23 |
| H-25 | 42 | 150 | 7.2 | 5010 | 22 |
| H-26 | 42 | 150 | 11.6 | 5395 | 17 |
| H-27 | 60 | 150 | 2.7 | 4612 | 18 |
| H-28 | 60 | 150 | 7.2 | 6683 | 18 |
| H-29 | 60 | 150 | 11.6 | 6143 | 15 |

The foregoing results, for both Examples 3 and 4, demonstrate the thermal bondability of the fibers of this invention. The indicated fabrics exhibit desirable strengths, these being the function of bonding temperatures and pressures.

EXAMPLE 5

Thermal bonded nonwoven structures were prepared, according to the conditions set forth below, from staple fibers of Run H, using the hot air bonding technique. The fibers were carded and formed into nonwoven webs, and heated air was passed through these webs to form the bonded nonwoven structures; the grab strengths and elongations of these bonded fabrics was measured in the cross-direction (CD), using the ASTM D-1682-64 test procedure.

| Sample # | Fabric Weight (g/Sq. Meter) | Air Temp. (°C.) | CD Grab Strength (g) | CD Elongation (%) |
|---|---|---|---|---|
| H-30 | 47 | 139 | 294 | 34 |
| H-31 | 48 | 144 | 250 | 29 |
| H-32 | 56 | 149 | 455 | 26 |
| H-33 | 77 | 150 | 866 | 18 |
| H-34 | 76 | 150 | 683 | 19 |
| H-35 | 41 | 150 | 330 | 23 |
| H-36 | 37 | 150 | 290 | 33 |
| H-37 | 48 | 150 | 226 | 39 |
| H-38 | 37 | 159 | 825 | 37 |

The above results demonstrate that through-air bonding can also be employed for preparing nonwoven structures from fibers of the invention, and is capable of providing lofty nonwoven structures, exhibiting desirable properties.

EXAMPLE 6

Thermal bonded nonwoven fabric structures were prepared, according to the conditions set forth below, from staple fiber of Runs I and J. The staple fibers were carded into nonwoven webs of different basis weights, and thermally bonded, using one smooth calender roll, and one engraved calender roll with bonding points having a total bond area of 15 percent.

The calender roll pressure was kept constant at 7.2 kg/cm, and the rolls temperature varied, as indicated below. The fabrics were tested for strength in the machine direction (MD) and the cross-section (CD); as with Examples 3, 4, and 5, the fabric grab strengths and elongations were measured using the ASTM D1682-64 test procedure.

| Sample # | Fabric Weight ($g/m^2$) | Line Speed (m/min.) | Roll Temp. (°C.) | MD Strength (g) | MD Elong. (%) | CD Strength (g) | CD Elong. (%) |
|---|---|---|---|---|---|---|---|
| I-1 | 48 | 75 | 161 | 2510 | 26 | 890 | 71 |
| J-1 | 47 | 30 | 158 | 4381 | 42 | 942 | 109 |
| J-2 | 47 | 30 | 161 | 4265 | 32 | 1000 | 117 |
| J-3 | 48 | 75 | 161 | 2485 | 38 | 2549 | 52 |

The foregoing data, like that of the previous Examples demonstrate the thermal bondability of the fibers of this invention. These results indicate that the fabrics, obtained from the procedure of Example 6, exhibit desirable strengths.

Finally, although the invention has been described with reference to particular means, materials, and embodiments, it should be noted that the invention is not limited to the particulars disclosed, and extends to all equivalents within the scope of the claims.

What is claimed is:

1. A multiconstituent fiber, comprising;

a) a first polymer, as a continuous phase; and (b) at least one second polymer, as at least one discontinuous phase, randomly dispersed through the continuous phase, in the form of domains;

wherein at least 40 percent by weight of the domains have a first dimension of at least 5 percent of the equivalent diameter of the fiber, and have a second dimension of at least 20 microns.

2. The multiconstituent fiber of claim 1, wherein at least 40 percent by weight of the domains have a first dimension of at least 10 percent of the equivalent diameter of the fiber, and have a second dimension of at least 100 microns.

3. The multiconstituent fiber of claim 2, wherein at least about 50 percent by weight of the domains have a first dimension of from about 10 percent to about 80 percent of the equivalent diameter of the fiber, and have a second dimension of at least about 100 microns.

4. The multiconstituent fiber of claim 1, wherein there is a difference of at least 10° C. between the melting point of the first polymer and the melting point of the at least one second polymer.

5. The multiconstituent fiber of claim 1, wherein the melting point of the first polymer is at least about 10° C. higher than the melting point of the at least one second polymer.

6. The multiconstituent fiber of claim 6 which is a biconstituent fiber.

7. The multiconstituent fiber of claim 1, wherein the first polymer and the at least one second polymer comprise polypropylene and polyethylene, the polpropylene comprising from about 10 to about 90 percent, and the polyethylene comprising from about 90 to about 10 percent, by weight of the total weight of the polypropylene and the polyethylene.

8. The multiconstituent fiber of claim 1, wherein the first polymer and the at least one second polymer comprise polypropylene and an ethylene-propylene copolymer, the polypropylene comprising from about 10 to about 90 percent, and the ethylene-propylene copolymer comprising from about 90 to about 10 percent, by weight of the total weight of the polypropylene and the ethylene-propylene copolymer.

9. The multiconstituent fiber of claim 1 wherein the first polymer and the at least one second polymer are substantially immiscible or immiscible thermoplastic polymers of different melting points, selected from the group consisting of polypropylene, polyethylene, ethylene-propylene copolymers, polybutylenes, and poly 4-methyl-1-pentenes.

10. The multiconstituent fiber of claim 9 which is a biconstituent fiber.

11. The multiconstituent fiber of claim 10 wherein two polymers are present in the biconstituent fiber in amounts unequal by weight, and the polymer present in the lesser amount is that having the lower melting point.

12. The multiconstituent fiber of claim 11 wherein the two polymers are polypropylene and polyethylene, and the polymer present in the lesser amount is polyethylene.

13. The multiconstituent fiber of claim 12 wherein the polypropylene is linear polypropylene and the polyethylene is linear polyethylene.

14. The multiconstituent fiber of claim 11 wherein the two polymers are polypropylene and an ethylene-propylene copolymer, and the polymer present in the lesser amount is the ethylene-propylene copolymer.

15. The multiconstituent fiber of claim 10 wherein the second polymer is a polymer having a melting point lower than the melting point of the first polymer.

16. The multiconstituent fiber of claim 15 wherein the first polymer is polypropylene and the second polymer is polyethylene.

17. The multiconstituent fiber of claim 15 wherein the first polymer is polypropylene and the second polymer is an ethylene-propylene copolymer.

18. A multiconstituent fiber comprising at least two polymers randomly dispersed through the fiber as discontinuous phases in the form of domains, the fiber lacking a continuous phase polymer, wherein at least 40 percent by weight of the domains have a first dimension of at least 5 percent of the equivalent diameter of the fiber, and have a second dimension of at least 20 microns.

19. The multiconstituent fiber of claim 18, wherein there is a difference of at least about 10° C. between the melting points of the at least two polymers.

20. The multiconstituent fiber of claim 19 which is a biconstituent fiber.

21. The multiconstituent fiber of claim 11 wherein the at least two polymers are substantially immiscible or immiscible thermoplastic polymers, selected from the group consisting of polypropylene, polyethylene, ethylene-propylene copolymers, polybutylenes, and poly 4-methyl-1-pentenes.

22. The multiconstituent fiber of claim 21 which is a biconstituent fiber of polypropylene and polyethylene.

23. A nonwoven structure comprising multiconstituent fibers, the multiconstituent fibers comprising:

(a) a first polymer, as a continuous phase: and (b) at least one second polymer, as at least one discontinuous phase, randomly dispersed through the continuous phase, in the form of domains;

wherein at least about 40 percent by weight of the domains have a first dimension of at least about 5 percent of the equivalent diameter of the fiber, and have a second dimension of at least about 20 microns.

24. The nonwoven structure of claim 23, wherein there is a difference of at least 10° C. between the melting point of the first polymer and the melting point of the at least one second polymer.

25. The nonwoven structure of claim 24, wherein the first polymer and the at least one second polymer comprise polypropylene and polyethylene.

26. The nonwoven structure of claim 24, wherein the first polymer and the at least one second polymer comprise polypropylene and an ethylene-propylene copolymer.

27. The nonwoven structure of claim 23, wherein the melting point of the first polymer is at least about 10° C. higher than the melting point of the at least one second polymer.

28. The nonwoven structure of claim 23 wherein the first polymer and the at least one second polymer are substantially immiscible or immiscible thermoplastic polymers of different melting points, selected from the group consisting of polypropylene, polyethylene, ethylene-propylene copolymers, polybutylenes, and poly 4-methyl-1-pentenes.

29. The nonwoven structure of claim 28 wherein the multiconstituent fibers are biconstituent fibers.

30. The nonwoven structure of claim 29 wherein the two polymers of the biconstituent fibers are present in amounts unequal by weight, and the polymer present in the lesser amount is that having the lower melting point.

31. The nonwoven structure of claim 30 wherein the two polymers are polypropylene and one member selected from the group consisting of polyethylene and an ethylene-propylene copolymer, and the polymer present in the lesser amount is the one member selected from the group consisting of polyethylene and an ethylene-propylene copolymer.

32. The nonwoven structure of claim 31 wherein the polypropylene is linear polypropylene and the polymer present in the lesser amount is linear polyethylene.

33. The nonwoven structure of claim 29 wherein the second polymer is a polymer having a melting point lower than the melting point of first polymer.

34. The nonwoven structure of claim 33 wherein the first polymer is polypropylene and the second polymer is polyethylene.

35. The nonwoven structure of claim 33 wherein the first polymer is polypropylene and the second polymer is an ethylene-propylene copolymer.

36. A nonwoven structure comprising multiconstituent fibers, the multiconstituent fibers comprising at least two polymers randomly dispersed through the fibers as discontinuous phases in the form of domains, the fibers lacking continuous phase polymers, wherein at least 40 percent by weight of the domains have a first dimension of at least 5 percent of the equivalent diameter of the fiber, and have a second dimension of at least 20 microns.

37. The nonwoven structure of claim 36, wherein there is a difference of at least about 10° C. between the melting points of the at least two polymers.

38. The nonwoven structure of claim 37 wherein the at least two polymers are substantially immiscible or immiscible thermoplastic polymers, selected from the group consisting of polypropylene, polyethylene, ethylene-propylene copolymers, polybutylenes, and poly 4-methyl-1-pentenes.

39. The nonwoven structure of claim 38 wherein the multiconstituent fibers are biconstituent fibers of polypropylene and polyethylene.

* * * * *

UNITED STATES PATENT AND TRADEMARK OFFICE

CERTIFICATE OF CORRECTION

PATENT NO. : 5,554,441

DATED : September 10, 1996

INVENTOR(S) : Rakesh K. Gupta & Jon R. Williams

It is certified that error appears in the above-indentified patent and that said Letters Patent is hereby corrected as shown below:

Col. 12, Claim 3, line 2, delete "about", and line 5, delete "about".

Col. 13, Claim 19, line 2, delete "about".

Claim 23, lines 7, 8 and 10, delete "about" in each instance.

Claim 27, line 2, delete "about".

Signed and Sealed this

Seventh Day of January, 1997

*Attest:*

Bruce Lehman

BRUCE LEHMAN

*Attesting Officer*

*Commissioner of Patents and Trademarks*